United States Patent [19]

Holland-Letz

[11] 4,448,122

[45] May 15, 1984

[54] PRINT WHEELS HAVING MEANS FOR ROTATING A SELECTED PRINT WHEEL AND PREVENTING THE ROTATION OF PRINT WHEELS ADJACENT THE ROTATED PRINT WHEEL

[75] Inventor: Günter Holland-Letz, Hirschhorn, Fed. Rep. of Germany

[73] Assignee: Esselte Pendaflex Corporation, Garden City, N.Y.

[21] Appl. No.: 368,315

[22] Filed: Apr. 14, 1982

[51] Int. Cl.[3] ..... B41L 47/46

[52] U.S. Cl. ..... 101/91; 101/110; 101/86

[58] Field of Search ..... 101/86, 87, 91, 109, 101/110, 111

[56] References Cited

U.S. PATENT DOCUMENTS

| | | | |
|---|---|---|---|
| 1,341,021 | 5/1920 | Robbins | 101/110 |
| 3,363,549 | 1/1968 | Reus et al. | 101/91 |
| 3,796,152 | 3/1974 | Finke et al. | 101/111 |
| 4,050,375 | 9/1977 | Orlens | 101/111 X |
| 4,149,460 | 4/1979 | Sato | 101/110 |
| 4,265,174 | 5/1981 | Jenkins | 101/111 |
| 4,271,758 | 6/1981 | Osterhof | 101/91 X |
| 4,327,640 | 5/1982 | Hamisch, Jr. | 101/110 |

*Primary Examiner*—Edgar S. Burr
*Assistant Examiner*—John A. Weresh
*Attorney, Agent, or Firm*—Gerald J. Ferguson, Jr.; Joseph J. Baker

[57] ABSTRACT

The invention relates to a printing wheel for a rotary printer comprising a plurality of type rings (6) positioned side by side on a cylindrical support (3). On their outer periphery said type rings (6) carry printing types (9), while on their inner periphery they are provided with internal toothing (10) capable of meshing with a pinion (11) which, by means of an adjusting spindle (14) connected for co-rotation therewith, is axially slidable into the planes of the individual type rings (6). By means of the pinion (11) the type rings (6) can be rotated relative to one another on the support (3) to bring selected printing types (9) into a predetermined position of adjustment. In order to avoid that during adjustment of a type ring (6) the adjacent type rings (6) are carried along a locking member (16, 17) is provided on the adjusting spindle (14), on either side of the pinion (11), for rotation relative to the adjusting spindle (14), and is secured against axial shifting. The locking members (16, 17) are in positive engagement with the type rings (6) adjacent the type ring (6) whose inner toothing (10) is meshing with the pinion (11). The locking members (16, 17) are in positive engagement with the support (3).

7 Claims, 2 Drawing Figures

Figure 2:
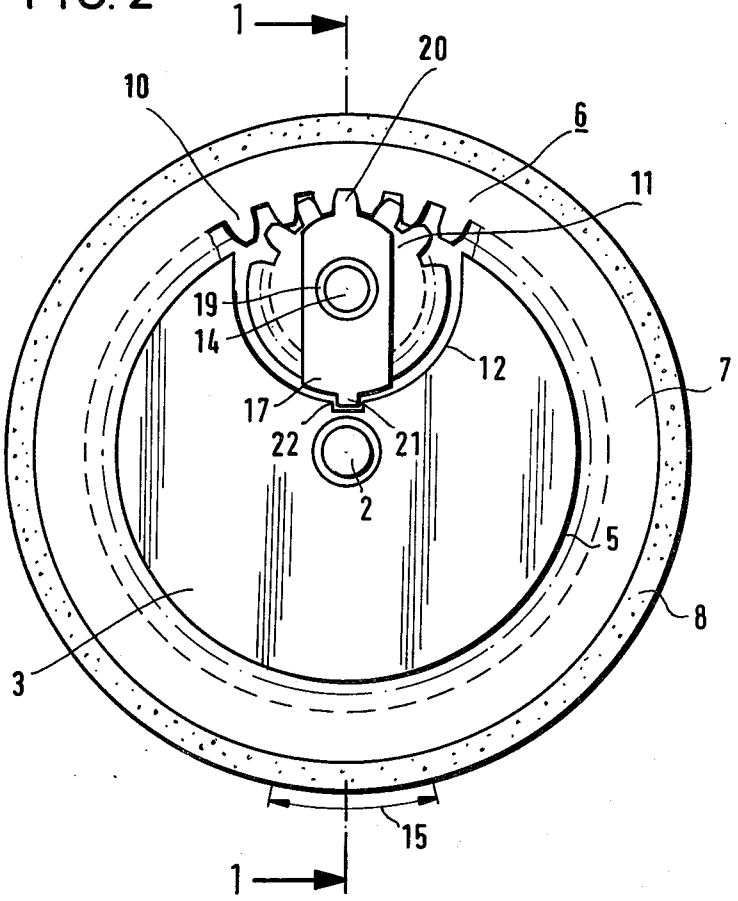

PRINT WHEELS HAVING MEANS FOR ROTATING A SELECTED PRINT WHEEL AND PREVENTING THE ROTATION OF PRINT WHEELS ADJACENT THE ROTATED PRINT WHEEL

The invention relates to a printing wheel for a rotary printer comprising a plurality of type rings positioned side by side on a cylindrical support for rotation relative to one another and carrying printing types on their outer periphery and provided with internal toothing on their inner periphery and a pinion which is accommodated in a recess in the support and which, by means of an adjusting spindle connected for co-rotation therewith, is axially slidable into the planes of the individual type rings and capable of meshing with the inner toothings of said type rings.

Such a printing wheel has been known from German Patent application No. P 30 30 105.4-27. When in said known printing wheel a type ring is rotated by turning the pinion by way of the adjusting spindle to bring a printing type on its outer periphery into a predetermined position of adjustment it may happen that a type ring adjacent the type ring being rotated is carried along somewhat by friction on account of the close proximity of the type rings. As a consequence the pinion, after termination of the adjustment of one type ring, cannot be axially shifted into the inner toothing of the entrained adjacent type ring because its teeth are misaligned. This jams the printing wheel temporarily, and it requires cumbersome manipulations to again bring the type rings into a position relative to each other so that the teeth of the inner toothing and the gaps therebetween are in precise alignment. Only thereafter can the pinion be brought into engagement with the inner toothing of further type rings to be adjusted.

The invention has the object to modify a printing wheel of the initially defined type so that unintentional rotation of type rings in performing a setting operation is prevented.

According to the invention, this problem is solved in that on the adjusting spindle, on either side of the pinion, a locking member is provided which is rotatable relative to the adjusting spindle and secured against axial shifting, that the locking members are in positive engagement with the type rings adjacent the type ring whose internal toothing is meshing with the pinion, and that the locking members are in positive engagement with the support.

In the printing wheel of the invention the locking members provided on either side of the pinion on the adjusting spindle lock against any undesirable rotation the type rings adjacent the type ring to be adjusted as they are in positive engagement both with said adjacent type rings and with the support carrying the type rings. This excludes unintentional rotation of type rings by frictional engagement.

In a favorable embodiment of the invention the locking members, for positive engagement with the type rings, have at least one tooth meshing with the inner toothing of the type rings, and are provided with a projection extending into a groove extending axially in the support.

An embodiment of the invention is illustrated in the drawing in which

Figure 1:
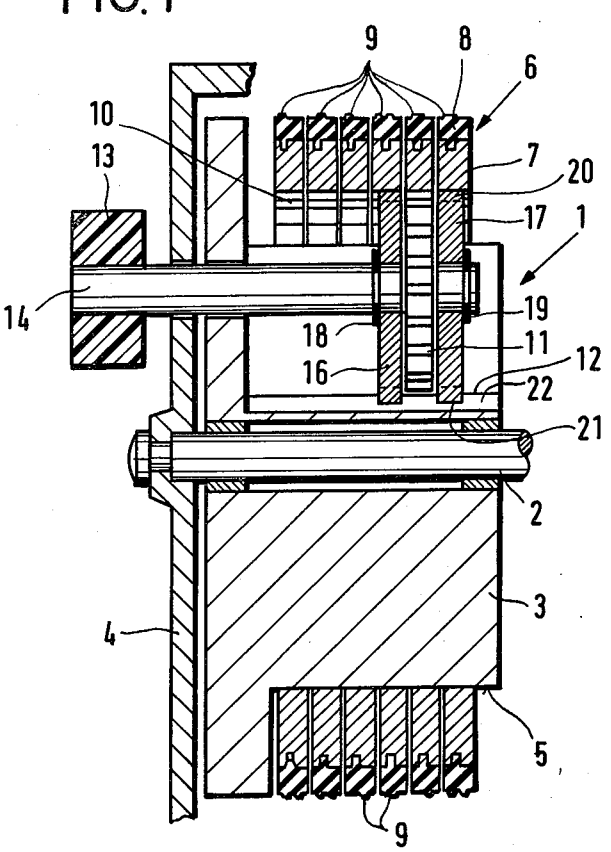

FIG. 1 shows a section along the line 1—1 of FIG. 2 through a printing wheel for a rotary printer, and FIG. 2 is a schematic side view of the printing wheel of FIG. 1.

The printing wheel shown in FIG. 1 includes a support 3 rotatable about a shaft 2. The shaft 2 is mounted in a housing 4 shown only schematically.

The printing wheel 3 has a section 5 of reduced diameter supporting the type rings 6. Each type ring 6 consists of an inner ring 7 carrying on its outer periphery an outer ring 8 of elastic material on whose outer periphery printing types 9 are formed. The type rings 6 are provided with internal toothing 10 around their inner periphery.

The type rings 6 can be rotated relative to one another by means of a pinion 11 accommodated in a recess 12 in the printing wheel 3. By an adjusting spindle 14 carrying a turning knob 13 and mounted for co-rotation with the pinion 11 the latter can be shifted parallel to the shaft of the printing wheel and rotated about its axis. In the position shown in FIG. 1 the pinion 11 meshes with the inner toothing of the type ring 6 second from right so that said ring can be rotated relative to the other type rings.

In a region of the printing wheel periphery forming the printing zone a counterpressure surface (not shown) is provided opposite the periphery of the printing wheel by means of which a recording medium can be pressed against the printing types inked by an inking means (not shown) and then moved into the printing zone by rotation of the printing wheel 3 about the shaft 2 so that a print is produced on the recording medium. By way of example the printing zone is schematically outlined in the region 15 of FIG. 2.

In order to print a desired multiple-digit character the individual type rings must be successively rotated by means of the adjusting spindle 14 and the pinion 11 mounted thereto so that the types to be printed are positioned in a predetermined region at the periphery of the printing wheel 3. To this end the pinion 11 is successively moved into engagement with each of the type rings 6 to be set and then rotated until the desired printing type is positioned in said predetermined region. Shifting of the adjusting pinion parallel to the axis of the printing wheel is possible only when the teeth of the inner toothing 10 of the type rings 6, after a setting operation, are in precise axial alignment. Only then can the teeth of the pinion 11 freely pass through the matching gaps in the inner toothing 10 of the type rings 6. The printing types 9 are provided at the outer periphery of the type rings 6 so that the teeth of all type rings 6 are at all times in precise alignment when a printing type 9 on each type ring 6 is positioned precisely in the printing zone in the region 15.

A shift due to frictional engagement of type rings 6 adjacent to the type ring to be actually set is prevented by means of locking members 16 and 17 provided on either side of the pinion 11 on the adjusting spindle 14. These locking members 16, 17 are secured against axial shifting on the adjusting spindle 14 by means of securing rings 18, 19, while they are not connected to the adjusting spindle 14.

The locking members 16, 17 have a tooth 20 at their end disposed on top in FIGS. 1 and 2 which, like a tooth of the pinion 11, can engage the inner toothing 10 of the type rings 6. At the diametrically opposed end the locking members 16, 17 are provided each with a projection 21 extending into a matching groove 22 in the recess 12 of the support 3. From FIG. 2 it is apparent that the positive engagement between the projections 21 at the locking members 16, 17 and the groove 22 prevents rotation of the locking members 16, 17 about the axis of the adjusting spindle 14. When the pinion 11 meshes with the inner toothing 10 of the type ring 6 second from right as shown in FIG. 1, the teeth 20 at the locking members 16, 17 simultaneously engage the inner toothing 10 of the type rings adjacent the type ring 6 being set. Since the locking members 16, 17 cannot rotate about the adjusting spindle 14 owing to the engagement between the projections 21 and the groove 22, the type rings adjacent the type ring 6 to be adjusted are safely locked, even if they are in contact with the type ring 6 to be adjusted, and even if frictional forces are exerted thereon. Hence, the locking members 16 and 17 take care that, when a type ring 6 is rotated, the adjacent type rings are locked in their exact positions so that the pinion can easily be brought into engagement with the inner toothing of an adjacent type ring 6, after setting of a type ring 6, by axial shifting of the adjusting spindle 14.

What is claimed is:

1. A printing wheel for a rotary printer comprising:

a cylindrical support having a recess longitudinally extending therethrough;

a plurality of print rings positioned adjacent one another on the periphery of said cylindrical support, each said print ring having a plurality of internal teeth disposed along the inner periphery thereof;

an adjusting spindle having a pinion non-rotatably disposed thereon;

means for mounting said spindle and pinion within said recess;

means for axially shifting said spindle in said recess to effect engagement of said pinion with the internal teeth of a selected one of said plurality of print rings to thereby permit rotation of the selected print ring to a desired position;

rotation prevention means for preventing rotation of the print rings adjacent said selected print ring as the selected print ring is being rotated, said rotation prevention means including first and second locking members rotatably disposed on said adjusting spindle and respectively associated with the print rings on the opposite sides of the selected print ring, each said locking member including first engaging means for fixedly engaging its associated print ring and a second engaging means for fixedly engaging the recess for locking the associated print rings in place as the selected print ring is rotated, said first and second engaging means respectively fixedly engaging said associated print wheel and said recess in a common plane, said plane being substantially perpendicular to the adjusting spindle.

2. A printing wheel as in claim 1 where said first engaging means engages an internal tooth of its associated print ring.

3. A printing wheel as in claim 2 where said recess has a groove longitudinally extending therein and where said second engaging means engages said groove in the recess.

4. A printing wheel as in claim 1 where said recess has a groove longitudinally extending therein and where said second engaging means engages said groove in the recess.

5. A printing wheel as in claim 1 where the width of each said first and second locking members in the longitudinal direction of the recess is approximately that of its associated print wheel.

6. A printing device as in claim 5 where said first and second engaging means each comprises a lug where each lug extends from a different portion of the periphery of its associated locking member.

7. A printing device as in claim 1 where said first and second engaging means each comprises a lug where each lug extends from a different portion of the periphery of its associated locking member.

* * * * *